US009316934B2

(12) United States Patent
Takahashi et al.

(10) Patent No.: US 9,316,934 B2
(45) Date of Patent: Apr. 19, 2016

(54) ORGANIC PHOTORECEPTOR AND PRODUCTION PROCESS THEREOF

(71) Applicant: Konica Minolta, Inc., Tokyo (JP)

(72) Inventors: Seijiro Takahashi, Tokyo (JP); Daisuke Kodama, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/488,759

(22) Filed: Sep. 17, 2014

(65) Prior Publication Data

US 2015/0086915 A1 Mar. 26, 2015

(30) Foreign Application Priority Data

Sep. 24, 2013 (JP) ..... 2013-196396

(51) Int. Cl.
*G03G 5/147* (2006.01)

(52) U.S. Cl.
CPC ..... *G03G 5/14704* (2013.01); *G03G 5/14734* (2013.01); *G03G 5/14791* (2013.01)

(58) Field of Classification Search
CPC ..... G03G 5/14704; G03G 5/14737; G03G 5/14708; G03G 5/14734
USPC ..... 430/66, 67, 58.2, 130, 132
See application file for complete search history.

(56) References Cited

U.S. PATENT DOCUMENTS 6,004,710 A * 12/1999 Takagi ..... G03G 5/14791 399/297

FOREIGN PATENT DOCUMENTS

JP 2010-197462 A 9/2010

* cited by examiner

*Primary Examiner* — Janis L Dote
(74) *Attorney, Agent, or Firm* — Lucas & Mercanti, LLP

(57) ABSTRACT

The organic photoreceptor includes a conductive support, an organic photosensitive layer, and a surface layer made of a cured resin, which are stacked in this order. The surface layer is obtained by curing a composition containing a radical polymerizable compound for forming the cured resin, metal oxide fine particles having a surface treated with a silane coupling agent, and a silane compound represented by the following general formula (1), General Formula (1)

wherein $R^1$ to $R^3$ each independently represent a hydrogen atom, an alkyl group having 1 to 10 carbon atoms or an aryl group having 6 to 20 carbon atoms, and at least one of $R^1$ to $R^3$ represents an alkyl group having 1 to 10 carbon atoms or an aryl group having 6 to 20 carbon atoms.

6 Claims, No Drawings

ORGANIC PHOTORECEPTOR AND PRODUCTION PROCESS THEREOF

CROSS REFERENCE TO RELATED APPLICATION

This Application claims the priority of Japanese Patent Application No. 2013-196396 filed on Sep. 24, 2013, which is incorporated by reference herein.

TECHNICAL FIELD

The present invention relates to an organic photoreceptor, which is used in image formation in an electrophotographic system, and a production process of the organic photoreceptor.

BACKGROUND ART

Organic photoreceptors (hereinafter also referred to simply as "photoreceptors") having a surface layer made of a cured resin as a protective layer have been widely used. The cured resin constituting the surface layer is usually produced by polymerization of a polymerizable compound by heat, electron beam, ultraviolet rays, or the like.

The surface layer is usually formed by applying a coating liquid in which a curable, polymerizable compound(s) for forming a cured resin, a polymerization initiator and other optional components are dissolved or dispersed in a suitable solvent, to the surface of an organic photosensitive layer formed on a conductive support, and curing the obtained coating film to give a cured resin.

When the curing process is performed by a radical polymerization reaction with ultraviolet irradiation to undergo polymerization of a radical polymerizable compound, the radical polymerization reaction has been known to be inhibited by oxygen in the air, called oxygen inhibition. This oxygen inhibition hinders the radical polymerization reaction to provide a surface layer which generally has low hardness and also has a large variation in hardness. This leads to uneven abrasion of the surface of a photoreceptor after long time use and finally causes in-plane image density unevenness.

To suppress this oxygen inhibition, there have been proposed curing processes under inert atmosphere such as nitrogen and addition of a chain transfer agent containing a thiol compound to a coating liquid (see, for example, Patent Literature 1).

However, the radical polymerization under inert atmosphere and the use of a chain transfer agent containing a thiol compound as described above failed to sufficiently prevent uneven abrasion of the surface of a photoreceptor.

CITATION LIST

Patent Literature

Patent Literature 1: Japanese Patent Application Laid-Open No. 2010-197462

SUMMARY OF INVENTION

Technical Problem

The present invention has been made in view of the foregoing circumstances and has as its object the provision of an organic photoreceptor which causes no uneven abrasion of the surface of the photoreceptor over a long period of time and provides stable, high evenness of in-plane image density, and a production process of such an organic photoreceptor.

Solution to Problem

An organic photoreceptor according to the present invention includes a conductive support, an organic photosensitive layer, and a surface layer made of a cured resin, which are stacked in this order, wherein the surface layer is obtained by curing a composition containing a radical polymerizable compound for forming the cured resin, metal oxide fine particles having a surface treated with a silane coupling agent, and a silane compound represented by the following general formula (1), General Formula (1)

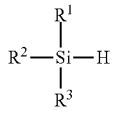

wherein $R^1$ to $R^3$ each independently represent a hydrogen atom, an alkyl group having 1 to 10 carbon atoms or an aryl group having 6 to 20 carbon atoms, and at least one of $R^1$ to $R^3$ represents an alkyl group having 1 to 10 carbon atoms or an aryl group having 6 to 20 carbon atoms.

In the organic photoreceptor as above, the silane compound may preferably be triethylsilane, tripropylsilane, diethylsilane, dipropylsilane, or methylphenylsilane.

In the organic photoreceptor as above, the content ratio of the silane compound may preferably be 1 to 30 parts by mass per 100 parts by mass of the radical polymerizable compound for forming the cured resin that constitutes the surface layer.

In the organic photoreceptor as above, the content ratio of the silane compound may preferably be 10 to 20 parts by mass per 100 parts by mass of the radical polymerizable compound for forming the cured resin that constitutes the surface layer.

In the organic photoreceptor as above, the metal oxide fine particles may preferably be made of tin oxide.

A production process of an organic photoreceptor according to the present invention is a production process of an organic photoreceptor including a conductive support, an organic photosensitive layer, and a surface layer made of a cured resin, which are stacked in this order, the process including:

applying a composition containing a radical polymerizable compound for forming the cured resin, metal oxide fine particles having a surface treated with a silane coupling agent, and a silane compound represented by the following general formula (1), to the organic photosensitive layer formed on the conductive support to form a coating film; and curing the coating film to form the surface layer, General Formula (1)

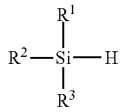

wherein $R^1$ to $R^3$ each independently represent a hydrogen atom, an alkyl group having 1 to 10 carbon atoms or an aryl group having 6 to 20 carbon atoms, and at least one of $R^1$ to $R^3$ represents an alkyl group having 1 to 10 carbon atoms or an aryl group having 6 to 20 carbon atoms.

Advantageous Effects of Invention

The organic photoreceptor of the present invention causes no uneven abrasion of the surface of the photoreceptor even after long time use and provides stable, high evenness of in-plane image density because the surface layer is obtained by curing the composition containing the silane compound represented by the above general formula (1).

DESCRIPTION OF EMBODIMENTS

The present invention will be specifically described below.

Organic Photoreceptor:

The organic photoreceptor of the present invention includes a conductive support, an organic photosensitive layer, and a surface layer made of a cured resin, which are stacked in this order. Specifically, the organic photoreceptor of the present invention can have layer structures (1) and (2) described below.

(1) A layer structure including a conductive support, an intermediate layer, a charge generating layer and a charge transport layer collectively serving as an organic photosensitive layer, and a surface layer, which are stacked in this order.

(2) A layer structure including a conductive support, an intermediate layer, a single layer containing a charge generating material and a charge transport material serving as an organic photosensitive layer, and a surface layer, which are stacked in this order.

In the present invention, the organic photoreceptor refers to photoreceptors whose at least one of the charge generating function and the charge transport function, essential for the configuration of the organic photoreceptor, is achieved by an organic compound, and includes any known organic photoreceptors such as organic photoreceptors having a photosensitive layer containing a known organic charge generating material or organic charge transport material, and organic photoreceptors having a photosensitive layer containing a polymer complex responsible for the charge generating function and the charge transport function.

Surface Layer:

The surface layer serves as a protective layer, which is obtained by curing a composition containing a radical polymerizable compound for forming the cured resin, metal oxide fine particles having the surface treated with a silane coupling agent, and a silane compound represented by the general formula (1) above (hereinafter also referred to as a "specified silane compound"). The surface layer may further contain glidant particles, an antioxidant, or resins other than the cured resin as appropriate.

Specified Silane Compound:

The specified silane compound is either in the liquid state or in the solid state at room temperature.

In the general formula (1) representing the specified silane compound, $R^1$ to $R^3$ each independently represent a hydrogen atom, an alkyl group having 1 to 10 carbon atoms or an aryl group having 6 to 20 carbon atoms, and at least one, preferably two, of $R^1$ to $R^3$ represent an alkyl group having 1 to 10 carbon atoms or an aryl group having 6 to 20 carbon atoms.

Specific examples of the specified silane compound to be preferably used include triethylsilane, tripropylsilane, diethylsilane, dipropylsilane and methylphenylsilane.

The content ratio of the specified silane compound is preferably 1 to 30 parts by mass, preferably 10 to 20 parts by mass per 100 parts by mass of the radical polymerizable compound for forming the cured resin that constitutes the surface layer.

When the content ratio of the specified silane compound is not lower than 1 part by mass per 100 parts by mass of the radical polymerizable compound for forming the cured resin, the specified silane compound can function well as a chain transfer agent and can suppress oxygen inhibition sufficiently during the curing process. When the content ratio of the specified silane compound is not more than 30 parts by mass per 100 parts by mass of the radical polymerizable compound for forming the cured resin, the surface layer to be obtained has sufficiently high film density (degree of crosslinking), thereby preventing production of a weak surface layer.

Radical Polymerizable Compound:

As examples of the radical polymerizable compound for forming the cured resin, may be mentioned styrene-based monomers, acrylic monomers, (meth)acrylic monomers, vinyltoluene-based monomer, vinyl acetate-based monomer and N-vinylpyrrolidone-based monomer. These radical polymerizable compounds may be used either singly or in any combination thereof. These may be used in the form of a monomer or in the form of an oligomer.

As the radical polymerizable compound, (meth)acrylic monomers having a reactive group such as an acryloyl group ($CH_2{=}CHCO{-}$) and a methacryloyl group ($CH_2{=}CCH_3CO{-}$) are preferably used because these monomers can be cured with a small amount of light or for a short period of time.

Specific examples of (meth)acrylic monomers having an acryloyl group or a methacryloyl group include compounds (1) to (44) illustrated below. The number of groups shown below refers to the number of acryloyl groups or methacryloyl groups.

| Illustrative Compound | Structural Formula | Number of Groups |
|---|---|---|
| 1 | 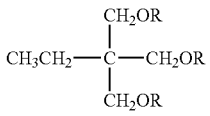 | 3 |
| 2 | 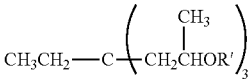 | 3 |
| 3 | 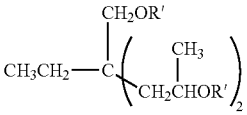 | 3 |

-continued
| Illustrative Compound | Structural Formula | Number of Groups |
|---|---|---|
| 4 | $CH_3CH_2-C(CH_2CHOR-CH_3)(CH_2OR)_2$ | 3 |
| 5 | $HOCH_2-C(CH_2OR')_3$ | 3 |
| 6 | $HOCH_2-C(CH_2OR)_2-CH_2OCH_2-C(CH_2OR)_2-CH_2OH$ | 4 |
| 7 | $ROCH_2-C(CH_2OR)_2-CH_2OCH_2-C(CH_2OR)_2-CH_2OR$ | 6 |
| 8 | $(R'OCH_2)_3C-CH_2OCH_2-C(CH_2OR')(R'OC_5H_{10}-C(=O)-O)_2$ | 6 |
| 9 | 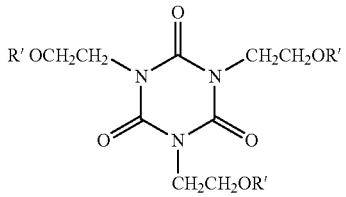 | 3 |
| 10 | $CH_3CH_2C(CH_2OC_3H_6OR)_3$ | 3 |
| 11 | 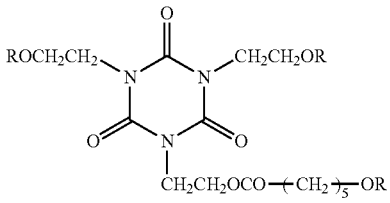 | 3 |
| 12 | $(ROCH_2)_3C-O-C(CH_2OR)_3$ | 6 |
| 13 | $(ROCH_2)_3C-CH_2OCH_2-C(H)(CH_2OR)_2$ | 5 |
| 14 | $(ROCH_2)_3C-CH_2OCH_2-C(CH_3)(CH_2OR)_2$ | 5 |
| 15 | $(ROCH_2)_3C-CH_2OCH_2-C(CH_2OH)(CH_2OR)_2$ | 5 |
| 16 | $(R'OCH_2)_3C-CH_2OCH_2-C(CH_2OR')(CH_2OH)_2$ | 4 |

-continued
| Illustrative Compound | Structural Formula | Number of Groups |
|---|---|---|
| 17 | $(ROCH_2)_3C-O-C(CH_2OH)(CH_2OR)_2$ | 5 |
| 18 | 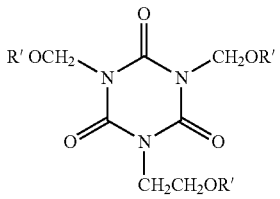 | 3 |
| 19 | $CH_3CH_2C(CH_2CH_2OR)_3$ | 3 |
| 20 | $HOCH_2-C\left(CH_2O-C(=O)CH_2CH_2CH_2CH_2CH_2OR\right)_3$ | 3 |
| 21 | 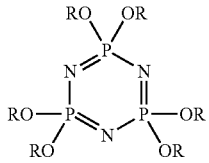 | 6 |
| 22 | 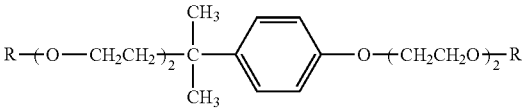 | 2 |
| 23 | 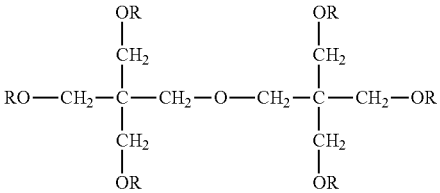 | 6 |
| 24 | 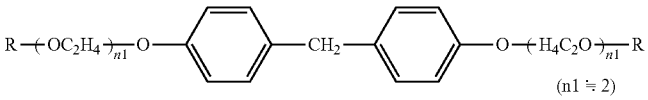 (n1 ≒ 2) | 2 |
| 25 | 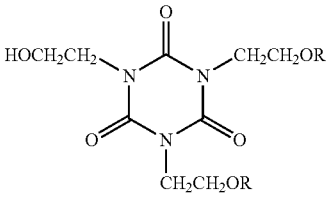 | 2 |
| 26 | $R-(OC_3H_6)_3-OR$ | 2 |
| 27 | 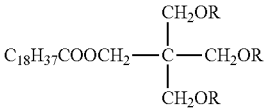 | 2 |

-continued
| Illustrative Compound | Structural Formula | Number of Groups |
|---|---|---|
| 28 | 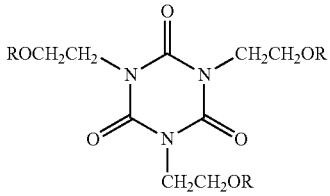 | 3 |
| 29 | $[R-(OC_3H_6)_{n2}-OCH_2)_3CCH_2CH_3$ (n2 ≒ 3) | 3 |
| 30 | 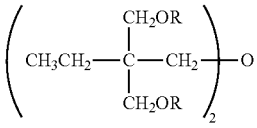 | 4 |
| 31 | $(ROCH_2)_4C$ | 4 |
| 32 | $RO—C_6H_{12}—OR$ | 2 |
| 33 | 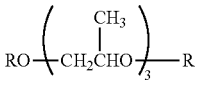 | 2 |
| 34 | 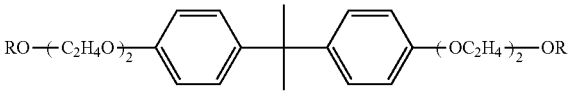 | 2 |
| 35 | 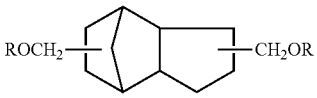 | 2 |
| 36 | $RO-(C_2H_4O)_9-R$ | 2 |
| 37 | 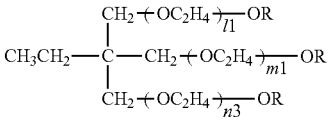 (l1 + m1 + n3 = 3) | 3 |
| 38 | 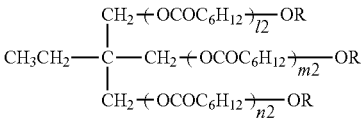 (l2 + m2 + n4 = 3) | 3 |
| 39 | Mixture of 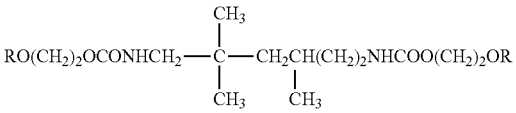 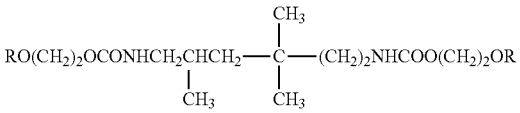 | 2 |
| 40 | $(ROCH_2)_3CCH_2OCONH(CH_2)_6NHCOOCH_2C(CH_2OR)_3$ | 6 |

-continued

| Illustrative Compound | Structural Formula | Number of Groups |
|---|---|---|
| 41 | 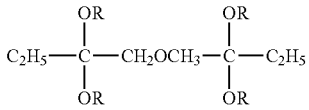 | 4 |
| 42 | 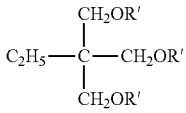 | 3 |
| 43 | 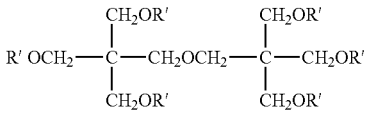 | 6 |
| 44 | 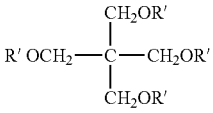 | 4 |

In the compounds (1) to (44) illustrated above, R represents an acryloyl group and R' represents a methacryloyl group.

The radical polymerizable compounds are preferably compounds having two or more acryloyl groups or methacryloyl groups, particularly preferably compounds having three or more acryloyl groups or methacryloyl groups.

The radical polymerizable compounds can be used in any combination thereof, in which case 50% by mass or more of compounds having three or more acryloyl groups or methacryloyl groups are also preferably used.

Metal Oxide Fine Particles:

The surface layer contains metal oxide fine particles having the surface treated with a silane coupling agent. The metal oxide fine particles are obtained by treating the surface of material metal oxide fine particles (hereinafter also referred to as "untreated metal fine oxide particles") with a silane coupling agent to introduce a reactive organic group to the surface of the untreated metal oxide fine particles.

As examples of the untreated metal oxide fine particles to be used, may be mentioned silica (silicon oxide), magnesium oxide, zinc oxide, lead oxide, alumina (aluminum oxide), zirconium oxide, tin oxide, titania (titanium oxide), niobium oxide, molybdenum oxide and vanadium oxide. Of these, tin oxide may preferably be used from the viewpoint of hardness, conductivity and optical transparency.

The number average primary particle size of the metal oxide fine particles is preferably from 1 to 300 nm, more preferably from 3 to 100 nm, still more preferably from 5 to 40 nm.

In the present invention, the number average primary particle size of the metal oxide fine particles is obtained by the following procedure: photographing the metal oxide fine particles at 10000× with a scanning electron microscope (manufactured by JEOL Ltd.); reading photographs of randomly-selected 300 particles (except for aggregated particles) with a scanner; and calculating the number average primary particle size based on the photographs using an automatic image processor "LUZEX AP (software version Ver. 1.32)" (manufactured by Nireco Corporation).

As the silane coupling agent, those having a radical polymerizable reactive group are preferably used. Examples of the radical polymerizable reactive groups include a vinyl group, an acryloyl group and a methacryloyl group. Such radical polymerizable reactive groups can also react with the radical polymerizable compound for forming the cured resin to form a firm surface layer.

Specific examples of the silane coupling agents having a radical polymerizable reactive group include silane coupling agents having an acryloyl group or a methacryloyl group represented by the following exemplary compounds (S-1) to (S-36).

S-1: $CH_2{=}CHSi(CH_3)(OCH_3)_2$
S-2: $CH_2{=}CHSi(OCH_3)_3$
S-3: $CH_2{=}CHSiCl_3$
S-4: $CH_2{=}CHCOO(CH_2)_2Si(CH_3)(OCH_3)_2$
S-5: $CH_2{=}CHCOO(CH_2)_2Si(OCH_3)_3$
S-6: $CH_2{=}CHCOO(CH_2)_2Si(OC_2H_5)(OCH_3)_2$
S-7: $CH_2{=}CHCOO(CH_2)_3Si(OCH_3)_3$
S-8: $CH_2{=}CHCOO(CH_2)_2Si(CH_3)Cl_2$
S-9: $CH_2{=}CHCOO(CH_2)_2SiCl_3$
S-10: $CH_2{=}CHCOO(CH_2)_3Si(CH_3)Cl_2$
S-11: $CH_2{=}CHCOO(CH_2)_3SiCl_3$
S-12: $CH_2{=}C(CH_3)COO(CH_2)_2Si(CH_3)(OCH_3)_2$
S-13: $CH_2{=}C(CH_3)COO(CH_2)_2Si(OCH_3)_3$
S-14: $CH_2{=}C(CH_3)COO(CH_2)_3Si(CH_3)(OCH_3)_2$
S-15: $CH_2{=}C(CH_3)COO(CH_2)_3Si(OCH_3)_3$
S-16: $CH_2{=}C(CH_3)COO(CH_2)_2Si(CH_3)Cl_2$
S-17: $CH_2{=}C(CH_3)COO(CH_2)_2SiCl_3$
S-18: $CH_2{=}C(CH_3)COO(CH_2)_3Si(CH_3)Cl_2$
S-19: $CH_2{=}C(CH_3)COO(CH_2)_3SiCl_3$
S-20: $CH_2{=}CHSi(C_2H_5)(OCH_3)_2$
S-21: $CH_2{=}C(CH_3)Si(OCH_3)_3$
S-22: $CH_2{=}C(CH_3)Si(OC_2H_5)_3$
S-23: $CH_2{=}CHSi(OCH_3)_3$
S-24: $CH_2{=}C(CH_3)Si(CH_3)(OCH_3)_2$
S-25: $CH_2{=}CHSi(CH_3)Cl_2$
S-26: $CH_2{=}CHCOOSi(OCH_3)_3$
S-27: $CH_2{=}CHCOOSi(OC_2H_5)_3$
S-28: $CH_2{=}C(CH_3)COOSi(OCH_3)_3$

S-29: $CH_2{=}C(CH_3)COOSi(OC_2H_5)_3$
S-30: $CH_2{=}C(CH_3)COO(CH_2)_3Si(OC_2H_5)_3$
S-31: $CH_2{=}CHCOO(CH_2)_2Si(CH_3)_2(OCH_3)$
S-32: $CH_2{=}CHCOO(CH_2)_2Si(CH_3)(OCOCH_3)_2$
S-33: $CH_2{=}CHCOO(CH_2)_2Si(CH_3)(ONHCH_3)_2$
S-34: $CH_2{=}CHCOO(CH_2)_2Si(CH_3)(OC_6H_5)_2$
S-35: $CH_2{=}CHCOO(CH_2)_2Si(C_{10}H_{21})(OCH_3)_2$
S-36: $CH_2{=}CHCOO(CH_2)_2Si(CH_2C_6H_5)(OCH_3)_2$

The amount of the silane coupling agent is preferably from 0.1 to 200 parts by mass, more preferably from 7 to 70 parts by mass per 100 parts by mass of the untreated metal oxide fine particles.

As examples of treatment processes of the untreated metal oxide fine particles with the silane coupling agent, may be mentioned wet crushing of a slurry (suspension of solid particles) containing the untreated metal oxide fine particles and the silane coupling agent. This process prevents reaggregation of the untreated metal oxide fine particles while the surface treatment of the untreated metal oxide fine particles proceeds. A solvent used is then removed to form powder.

As examples of surface treatment apparatuses, may be mentioned wet medium dispersion apparatuses. These wet medium dispersion apparatuses perform pulverization and dispersion process involving filling a container with beads as media and further revolving at high speed a stirring disk mounted perpendicularly to a rotational axis to crush aggregated particles of the untreated metal oxide fine particles. As the configurations thereof, various types can be adopted, for example, vertical, horizontal, continuous, and batch types, as long as the wet medium dispersion apparatuses enable sufficient dispersion and surface treatment of the untreated metal oxide fine particles during the surface treatment of the untreated metal oxide fine particles. Specific examples include sand mills, Ultra Visco Mill, pearl mills, grain mills, Dyno-Mill, agitator mills, and dynamic mills. These dispersion apparatuses enable fine grinding and dispersion by impact crushing, friction, shear, shearing stress, and the like using grinding media such as balls and beads.

As the beads used for the wet medium dispersion apparatuses, balls made of glass, alumina, zircon, zirconia, steel, flint stones, and the like can be used, and balls made of zirconia or zircon are particularly preferred. The beads having sizes about from 0.1 to 1.0 mm are preferably used in the present invention.

For disks and container inner walls which are used for the wet medium dispersion apparatuses, those made of various materials such as stainless steel, nylon, and ceramics can be used, and disks and container inner walls which are made of ceramics such as zirconia or silicon carbide are particularly preferred in the present invention.

The content ratio of the metal oxide fine particles in the surface layer is preferably from 20 to 170 parts by mass, more preferably from 25 to 130 parts by mass per 100 parts by mass of the cured resin. The cured resin in the surface layer may be formed by curing all radical polymerizable compounds contained in a surface layer forming liquid described below.

The surface layer according to the present invention may contain other components, for example, various antioxidants and glidant particles, in addition to the cured resin and the metal oxide fine particles. For example, fluorine atom-containing resin particles can be added to the surface layer. The fluorine atom-containing resin particles are preferably at least one selected from the group consisting of a tetrafluoroethylene resin, a trifluorochloroethylene resin, a hexafluorochloroethylene-propylene resin, a vinyl fluoride resin, a vinylidene fluoride resin, a difluorodichloroethylene resin and copolymers thereof. In particular, a tetrafluoroethylene resin and a vinylidene fluoride resin are preferred.

The thickness of the surface layer is preferably from 0.2 to 10 μm, more preferably from 0.5 to 6 μm.

Other components than the surface layer will be described below.

Conductive Support:

The conductive support of the photoreceptor can be any conductive materials. As examples thereof, may be mentioned drum-shaped or sheet-shaped metals of aluminum, copper, chromium, nickel, zinc, stainless steel, and the like; laminates of a plastic film and a metallic foil such as aluminum and copper; plastic films having deposition of aluminum, indium oxide, tin oxide, or the like; and metals, plastic films, and papers which have a conductive layer provided by application of a conductive material either singly or in combination with a binder resin.

Intermediate Layer:

The photoreceptor can also include an intermediate layer which has a barrier function and an adhesion function between the conductive support and the organic photosensitive layer. To prevent different damages, the intermediate layer may preferably be provided.

The intermediate layer contains, for example, a binder resin (hereinafter also referred to as a "binder resin for the intermediate layer"), and optional conductive particles and/or metal oxide particles.

As examples of the binder resin for the intermediate layer, may be mentioned casein, polyvinyl alcohol, cellulose nitrate, an ethylene-acrylic acid copolymer, polyamide resins, polyurethane resins and gelatin. Of these, alcohol-soluble polyamide resins are preferred.

The intermediate layer can contain various conductive particles and metal oxide particles to adjust the resistance. For example, various metal oxide particles such as alumina, zinc oxide, titanium oxide, tin oxide, antimony oxide, indium oxide and bismuth oxide can be used. Ultrafine particles of tin-doped indium oxide, antimony-doped tin oxide, antimony-doped zirconium oxide and the like can be used.

The average particle size of such metal oxide particles is preferably not more than 0.3 μm, more preferably not more than 0.1 μm.

These metal oxide particles may be used either singly or in any mixture thereof. Mixtures of two or more kinds of the metal oxide particles may be in the form of solid solutions or fusions.

The content ratio of the conductive particles or the metal oxide particles is preferably from 20 to 400 parts by mass, more preferably from 50 to 350 parts by mass per 100 parts by mass of the binder resin.

The thickness of the intermediate layer is preferably from 0.1 to 15 μm, more preferably from 0.3 to 10 μm.

Charge Generating Layer:

The charge generating layer in the organic photosensitive layer of the photoreceptor contains a charge generating material and a binder resin (hereinafter also referred to as a "binder resin for the charge generating layer").

As examples of the charge generating material, may be mentioned azo materials such as Sudan Red and Diane Blue, quinone pigments such as pyrene quinone and anthanthrone, quinocyanine pigments, perylene pigments, indigo pigments such as indigo and thioindigo, polycyclic quinone pigments such as pyranthrone and diphthaloylpyrene and phthalocyanine pigments, but the charge generating material is not limited thereto. Of these, polycyclic quinone pigments and titanyl phthalocyanine pigments are preferred. These charge generating materials may be used either singly or in any mixture thereof.

As the binder resin for the charge generating layer, known resins can be used. As examples thereof, may be mentioned a polystyrene resin, a polyethylene resin, a polypropylene resin, an acrylic resin, a methacrylic resin, a vinyl chloride resin, a vinyl acetate resin, a polyvinyl butyral resin, an epoxy resin, a polyurethane resin, a phenol resin, a polyester resin, an alkyd resin, a polycarbonate resin, a silicone resin, a melamine resin, copolymer resins containing two or more of these resins (for example, a vinyl chloride-vinyl acetate copolymer resin and a vinyl chloride-vinyl acetate-maleic anhydride copolymer resin) and a poly-vinylcarbazole resin, but the binder resin is not limited thereto. Of these, preferred is a polyvinyl butyral resin.

The content ratio of the charge generating material in the charge generating layer is preferably from 1 to 600 parts by mass, more preferably from 50 to 500 parts by mass per 100 parts by mass of the binder resin for the charge generating layer.

The thickness of the charge generating layer, depending on the properties of the charge generating material, the properties and the content ratio of the binder resin for the charge generating layer, etc., is preferably from 0.01 to 5 μm, more preferably from 0.05 to 3 μm.

Charge Transport Layer:

The charge transport layer in the organic photosensitive layer of the photoreceptor contains a charge transport material and a binder resin (hereinafter also referred to as a "binder resin for the charge transport layer").

As examples of the charge transport material contained in the charge transport layer, may be mentioned triphenylamine derivatives, hydrazone compounds, styryl compounds, benzidine compounds and butadiene compounds, which are substances transporting charges (positive holes).

As the binder resin for the charge transport layer, known resins can be used. As examples thereof, may be mentioned a polycarbonate resin, a polyacrylate resin, a polyester resin, a polystyrene resin, a styrene-acrylonitrile copolymer resin, a polymethacrylate resin and a styrene-methacrylate copolymer resin, and a polycarbonate resin is preferred.

The content ratio of the charge transport material in the charge transport layer is preferably from 10 to 500 parts by mass, more preferably from 20 to 250 parts by mass per 100 parts by mass of the binder resin for the charge transport layer.

The thickness of the charge transport layer, depending on the properties of the charge transport material, and the properties and the content ratio of the binder resin for the charge transport layer, etc., is preferably from 5 to 40 μm, more preferably from 10 to 30 μm.

The charge transport layer may contain an antioxidant, an electroconductive agent, a stabilizer, silicone oil, and the like. The antioxidant may be preferably those disclosed in Japanese Patent Application Laid-Open No. 2000-305291, and the electroconductive agent may be preferably those disclosed in Japanese Patent Application Laid-Open Nos. Sho. 50-137543 and 58-76483.

Production Process of Photoreceptor:

The production process of the photoreceptor according to the present invention is a production process of the above photoreceptor. The process includes:

applying a composition (surface layer forming liquid) containing a radical polymerizable compound for forming the cured resin, metal oxide fine particles having the surface treated with the silane coupling agent, and the specified silane compound to the organic photosensitive layer formed on the conductive support to form a coating film; and curing the coating film to form a surface layer.

Specifically, the photoreceptor of the present invention can be produced in the following manner, for example.

Step (1): forming the intermediate layer by applying an intermediate layer forming liquid to the periphery of the conductive support, followed by drying.

Step (2): forming the charge generating layer by applying a charge generating layer forming liquid to the periphery of the intermediate layer formed on the conductive support, followed by drying.

Step (3): forming the charge transport layer by applying a charge transport layer forming liquid to the periphery of the charge generating layer formed on the intermediate layer, followed by drying.

Step (4): forming the surface layer by applying a surface layer forming liquid to the periphery of the charge transport layer formed on the charge generating layer, followed by drying and curing process by active-ray irradiation or the like.

Step (1): Formation of Intermediate Layer

The intermediate layer can be formed as follows: dissolving the binder resin for the intermediate layer in a solvent to prepare an intermediate layer forming liquid; optionally dispersing the conductive particles or metal oxide particles in the liquid; then applying the intermediate layer forming liquid at a certain thickness to the conductive support to form a coating film; and drying the coating film.

As examples of the coating process of the intermediate layer forming liquid, may be mentioned known processes such as a dip coating method, a spray coating method, a spinner coating method, a bead coating method, a blade coating method, a beam coating method, a slide hopper coating method and a circular slide hopper coating method.

The drying process of the coating film can be appropriately selected depending on the type of the solvent and the film thickness, and may preferably be heat drying.

As the solvent used in the step of forming the intermediate layer, solvents capable of dispersing the conductive particles and the metal oxide particles well and dissolving the binder resin for the intermediate layer, particularly a polyamide resin are preferred. Specifically, alcohols having 1 to 4 carbon atoms such as methanol, ethanol, n-propyl alcohol, isopropyl alcohol, n-butanol, t-butanol, and sec-butanol are preferred because of excellent solubility of the polyamide resin and excellent coating performance. As examples of cosolvents which can be used in combination with the above solvents to improve the preservation and the dispersibility of the particles and can provide favorable effects, may be mentioned benzyl alcohol, toluene, methylene chloride, cyclohexanone and tetrahydrofuran.

The concentration of the binder resin for the intermediate layer in the intermediate layer forming liquid is appropriately selected according to the thickness and the production rate of the intermediate layer.

As a dispersing unit for the conductive particles and the metal oxide particles, ultrasonic dispersers, ball mills, sand mills, homomixers or the like can be used, but the dispersing unit is not limited thereto.

Step (2): Formation of Charge Generating Layer

The charge generating layer can be formed as follows: dispersing the charge generating material in a solution of the binder resin for the charge generating layer in a solvent to prepare a charge generating layer forming liquid; applying the charge generating layer forming liquid at a certain thickness to the intermediate layer to form a coating film; and drying the coating film.

As examples of the coating process of the charge generating layer forming liquid, may be mentioned known processes such as a dip coating method, a spray coating method, a spinner coating method, a bead coating method, a blade coating method, a beam coating method, a slide hopper coating method and a circular slide hopper coating method.

The drying process of the coating film can be appropriately selected depending on the type of the solvent and the film thickness, and may preferably be heat drying.

As examples of the solvent used for forming the charge generating layer, may be mentioned toluene, xylene, methylene chloride, 1,2-dichloroethane, methyl ethyl ketone, cyclohexane, ethyl acetate, t-butyl acetate, methanol, ethanol, propanol, butanol, methyl cellosolve, 4-methoxy-4-methyl-2-pentanone, ethyl cellosolve, tetrahydrofuran, 1-dioxane, 1,3-dioxolane, pyridine and diethylamine, but the solvent is not limited thereto.

As a dispersing unit for the charge generating material, for example, ultrasonic dispersers, ball mills, sand mills, homomixers or the like can be used, but the dispersing unit is not limited thereto.

Step (3): Formation of Charge Transport Layer:

The charge transport layer can be formed as follows: dissolving the binder resin for the charge transport layer and the charge transport material in a solvent to prepare a charge transport layer forming liquid; applying the charge transport layer forming liquid at a certain thickness to the charge generating layer to form a coating film; and drying the coating film.

As examples of the coating process of the charge transport layer forming liquid, may be mentioned known processes such as a dip coating method, a spray coating method, a spinner coating method, a bead coating method, a blade coating method, a beam coating method, a slide hopper coating method and a circular slide hopper coating method.

The drying process of the coating film can be appropriately selected depending on the type of the solvent and the film thickness, and may preferably be heat drying.

As examples of the solvent used for forming the charge transport layer, may be mentioned toluene, xylene, methylene chloride, 1,2-dichloroethane, methyl ethyl ketone, cyclohexane, ethyl acetate, butyl acetate, methanol, ethanol, propanol, butanol, tetrahydrofuran, 1,4-dioxane, 1,3-dioxolane, pyridine and diethylamine, but the solvent is not limited thereto.

Step (4): Formation of Surface Layer

The surface layer can be formed as follows: adding to a known solvent a radical polymerizable compound for forming the cured resin, a polymerization initiator and the metal oxide fine particles, and optionally, glidant particles, an antioxidant and other resins than the cured resin to prepare a surface layer forming liquid; applying the surface layer forming liquid to the periphery of the organic photosensitive layer (charge transport layer) to form a coating film; and curing the coating film by irradiation of energy rays such as light.

Such curing process causes progression of the reactions between the reactive organic groups introduced to the surface of the metal oxide fine particles, the reactions between the reactive organic group and the radical polymerizable compound, the reactions between the radical polymerizable compounds, and the like during drying and curing of the coating film, thereby providing a crosslinked cured resin.

During the curing process, nitrogen gas may preferably be supplied to suppress polymerization inhibition of oxygen gas such that the concentration of oxygen gas at the areas to be cured is, for example, not more than 500 ppm.

As the solvent used for forming the surface layer, any solvents capable of dissolving or dispersing the radical polymerizable compound and the metal oxide fine particles can be used. As examples of the solvent, may be mentioned methanol, ethanol, n-propyl alcohol, isopropyl alcohol, n-butanol, t-butanol, sec-butanol, benzyl alcohol, toluene, xylene, methylene chloride, methyl ethyl ketone, cyclohexane, ethyl acetate, butyl acetate, methyl cellosolve, ethyl cellosolve, tetrahydrofuran, 1-dioxane, 1,3-dioxolane, pyridine and diethylamine, but the solvent is not limited thereto.

As examples of the coating process of the surface layer forming liquid, may be mentioned known processes such as a dip coating method, a spray coating method, a spinner coating method, a bead coating method, a blade coating method, a beam coating method, a slide hopper coating method and a circular slide hopper coating method.

The coating film may be cured without drying, but may preferably be cured after natural drying or heat drying.

The conditions of the drying can be appropriately selected depending on the type of the solvent, the film thickness, and the like. The drying temperature is preferably from room temperature to 180° C., particularly preferably from 80 to 140° C. The drying time is preferably from 1 to 200 minutes, particularly preferably from 5 to 100 minutes.

As examples of processes of reacting the radical polymerizable compounds, may be mentioned a process of reacting them by electron-beam cleavage and a process of reacting them by light and heat after addition of a radical polymerization initiator.

As the radical polymerization initiator, any of photopolymerization initiators and thermal polymerization initiators can be used. In addition, a photopolymerization initiator and a thermal polymerization initiator can be also used in combination.

As examples of the thermal polymerization initiator, may be mentioned azo compounds such as 2,2'-azobisisobutyronitrile, 2,2'-azobis(2,4-dimethyl-azobisvaleronitrile), and 2,2'-azobis(2-methylbutyronitrile); and peroxides such as benzoyl peroxide (BPO), di-tert-butylhydroperoxide, tert-butylhydroperoxide, chlorobenzoyl peroxide, dichlorobenzoyl peroxide, bromomethylbenzoyl peroxide and lauroyl peroxide.

As examples of the photopolymerization initiator, may be mentioned acetophenone or ketal photopolymerization initiators such as diethoxyacetophenone, 2,2-dimethoxy-1,2-diphenylethan-1-one, 1-hydroxy-cyclohexyl-phenyl-ketone, 4-(2-hydroxyethoxy)phenyl-(2-hydroxy-2-propyl)ketone, 2-benzyl-2-dimethylamino-1-(4-morpholinophenyl)butanone-1 ("IRGACURE 369" manufactured by BASF Japan), 2-hydroxy-2-methyl-1-phenylpropan-1-one, 2-methyl-2-morpholino(4-methylthiophenyl)propan-1-one and 1-phenyl-1,2-propanedione-2-(o-ethoxycarbonyl)oxime; benzoin ether photopolymerization initiators such as benzoin, benzoin methyl ether, benzoin ethyl ether, benzoin isobutyl ether and benzoin isopropyl ether; benzophenone photopolymerization initiators such as benzophenone, 4-hydroxybenzophenone, methyl o-benzoylbenzoate, 2-benzoylnaphthalene, 4-benzoylbiphenyl, 4-benzoylphenylether, acrylated benzophenone and 1,4-benzoylbenzene; and thioxanthone photopolymerization initiators such as 2-isopropylthioxanthone, 2-chlorothioxanthone, 2,4-dimethylthioxanthone, 2,4-diethylthioxanthone and 2,4-dichlorothioxanthone.

As examples of other photopolymerization initiators, may be mentioned ethylanthraquinone, 2,4,6-trimethylbenzoyl diphenylphosphine oxide, 2,4,6-trimethylbenzoyl phenylethoxyphosphine oxide, bis(2,4,6-trimethyl benzoyl)phenylphosphine oxide ("IRGACURE 819" manufactured by BASF Japan), bis(2,4-dimethoxybenzoyl)-2,4,4-trimethylpentyl phosphine oxide, methylphenylglyoxy ester, 9,10-phenanthrene, acridine compounds, triazine compounds and imidazole compounds. Furthermore, photopolymerization accelerators, which can accelerate photopolymerization, can also be used either singly or in any combination with the above photopolymerization initiators. As examples of the photopolymerization accelerator, may be mentioned triethanolamine, methyldiethanolamine, ethyl 4-dimethylaminobenzoate, isoamyl 4-dimethylaminobenzoate, 2-(dimethylamino)ethyl benzoate and 4,4'-dimethylamino benzophenon.

As the radical polymerization initiator, the photopolymerization initiators are preferred, and alkylphenone-based compounds or phosphine oxide-based compounds are more preferred among them. In particular, compounds having an α-aminoalkylphenone structure or an acyl phosphine oxide structure are preferred.

The polymerization initiators may be used either singly or in any mixture thereof.

The content ratio of the polymerization initiator added is preferably from 0.1 to 20 parts by mass, more preferably from 0.5 to 10 parts by mass per 100 parts by mass of the radical polymerizable compound.

In the production process of this photoreceptor, the cured resin is produced by the curing process involving irradiating the coating film with active rays to generate radicals to undergo polymerization and forming crosslinking bonds by the crosslinking reactions between molecules and in molecules to cure the coating film. As the active rays, ultraviolet rays and electron beam are more preferred, and ultraviolet rays are particularly preferred because of ease of use.

As an ultraviolet ray source, any source that emits ultraviolet rays can be used without any limitation. For example, low-pressure mercury-vapor lamps, medium-pressure mercury-vapor lamps, high-pressure mercury-vapor lamps, ultra-high-pressure mercury-vapor lamps, carbon arc lamps, metal halide lamps, xenon lamps, flash (pulse) xenon, LED and the like can be used.

Although the irradiation conditions depend on the lamp, the radiation dose of active rays is usually form 5 to 500 $mJ/cm^2$, preferably from 5 to 100 $mJ/cm^2$.

The power of the ramp is preferably from 0.1 to 5 kW, particularly preferably from 0.5 to 3 kW.

There is no particular limitation on electron beam irradiators as a source of the electron beam. In general, an apparatus of relatively inexpensive, high power curtain beam type is effectively used as electron beam accelerators for such electron beam irradiation. The accelerating voltage for the electron beam irradiation may preferably be from 100 to 300 kV. The absorbed dose may preferably be from 0.5 to 10 Mrad.

The irradiation time to obtain the radiation dose of sufficient active rays is preferably from 0.1 seconds to 10 minutes, more preferably from 0.1 seconds to 5 minutes from the viewpoint of working efficiency.

In the step of forming the surface layer, the coating film can be dried before, during, and after the irradiation with the active rays, and the timing of drying can be appropriately selected in any combination of these.

The photoreceptor which has the surface layer made of the crosslinked cured resin can be obtained according to the above steps.

The organic photoreceptor of the present invention causes no uneven abrasion of the surface layer even after long time use or after printing many identical images, providing stable, high evenness of in-plane image density, because the surface layer is obtained by curing the composition containing the specified silane compound.

The reason that uneven abrasion is suppressed in the surface layer obtained by curing the composition containing the specified silane compound is supposed as follows.

That is, high hardness and small variation in hardness are required for the surface layer to suppress uneven abrasion of the surface layer.

The organic photoreceptor of the present invention is as follows.

(1) High hardness is basically obtained by containing the metal oxide fine particles in the surface layer.

(2) It is inferred that the polymerization inhibition of oxygen dissolved in the surface layer forming liquid can be sufficiently reduced by virtue of the effect of the specified silane compound serving as a chain transfer agent, and so the curing reactions may proceed well to provide the surface layer with high hardness and to suppress variation in hardness of the surface layer.

(3) Furthermore, it is inferred that the metal oxide fine particles are locally covered with the alkyl group moieties of the specified silane compound to generate interparticle forces such as electrostatic repulsion and hydrophobic interactions between the metal oxide fine particles, and interactions between the radical polymerizable compounds, and also to newly generate steric repulsion, thereby suppressing aggregations of the metal oxide fine particles in the surface layer forming liquid to provide good dispersibility of the metal oxide fine particles in the coating film, and further suppressing variation in hardness of the surface layer.

The organic photoreceptor of the present invention can suppress polymerization inhibition of oxygen dissolved in the surface layer forming liquid to reduce unreacted groups in the radical polymerization reactions, thereby reducing water- or $NO_x$-adsorbing sites (hydrophilic parts) to suppress image flowing under high temperature and high humidity environment.

Image Forming Apparatus:

The organic photoreceptor of the present invention can be used in various known electrophotographic image forming apparatuses such as monochrome image forming apparatuses and full-color image forming apparatuses.

Image forming apparatuses having the organic photoreceptor obtained by the production process of the present invention include: for example, a charging unit applying uniform charge potential onto the organic photoreceptor; an exposure unit forming an electrostatic latent image on the organic photoreceptor to which uniform charge potential is applied; a developing unit developing the electrostatic latent image through a toner to form a toner image; a transfer unit transferring the toner image onto a transfer material; a fixing unit fixing the toner image to the transfer material; and a cleaning unit removing the toner remaining on the organic photoreceptor.

Although the embodiment of the present invention is specifically described above, the embodiment of the present invention is not limited to the above examples, and various modifications can be made thereon.

EXAMPLES

Specific examples of the present invention will be described below, but the present invention is not limited to these.

Example 1

Photoreceptor Production Example 1

(1) Production of Conductive Support

The surface of a drum-shaped aluminum support (an outer diameter of 100 mm and a length of 360 mm) was machined to produce a conductive support [1] having surface roughness Rz of 1.5 (μm).

(2) Step of Forming Intermediate Layer

The following materials were dispersed batch-wise for 10 hours using a sand mill as a disperser to prepare an intermediate layer forming liquid [1].

Binder resin: 1 part by mass of a polyamide resin "X1010" (manufactured by Daicel-Evonik Ltd.)

Solvent: 20 parts by mass of ethanol

Metal oxide particles: 1.1 parts by mass of "MT-500SAS" (manufactured by TAYCA CORPORATION), titanium oxide particles having a number average primary particle size of 0.035 μm The intermediate layer forming liquid [1] was applied to the conductive support [1] by a dip coating method to form a coating film, and the coating film was dried at 110° C. for 20 minutes to form an intermediate layer [1] having a thickness of 2 μm.

(3) Step of Forming Organic Photosensitive Layer (Step of Forming Charge Generating Layer)

The following materials were dispersed for 10 hours using a sand mill as a disperser to prepare a charge generating layer forming liquid [1].

Charge generating material: 20 parts by mass of a titanyl phthalocyanine pigment (having a maximum diffraction peak at least at a position of 27.3° in Cu-Kα characteristic X-ray diffraction spectrometry)

Binder resin: 10 parts by mass of a polyvinyl butyral resin "#6000-C" (manufactured by DENKI KAGAKU KOGYO KABUSHIKI KAISHA)

Solvent: 700 parts by mass of t-butyl acetate

Solvent: 300 parts by mass of 4-methoxy-4-methyl-2-pentanone

The charge generating layer forming liquid [1] was applied to the intermediate layer [1] by a dip coating method to form a coating film, thereby forming a charge generating layer [1] having a thickness of 0.3 μm.

Step of Forming Charge Transport Layer:

The following materials were mixed and dissolved to prepare a charge transport layer forming liquid [1].

Charge transport material: 150 parts by mass of the compound represented by a formula (A) below Binder resin: 300 parts by mass of a polycarbonate resin "Z300" (manufactured by Mitsubishi Gas Chemical Company, Inc.)

Solvent: 2000 parts by mass of toluene/tetrahydrofuran (⅓ by volume %)

Antioxidant: 6 parts by mass of "IRGANOX 1010" (manufactured by Ciba-Geigy Japan Ltd.)

Leveling agent: 1 part by mass of a silicone oil "KF-54" (manufactured by Shin-Etsu Chemical Co., Ltd.)

The charge transport layer forming liquid [1] was applied to the charge generating layer [1] by a dip coating method to form a coating film, and the coating film was dried at 120° C. for minutes to form a charge transport layer [1] having a thickness of 20 μm.

Formula (A)

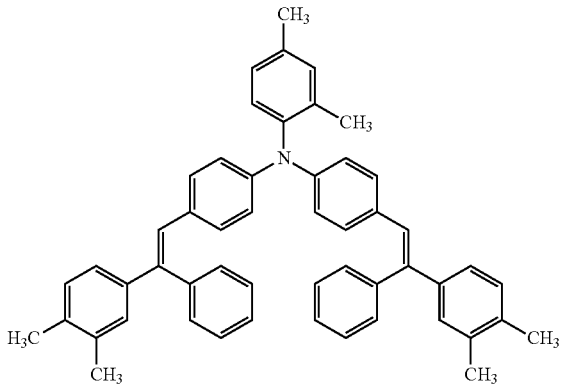

(4) Step of Forming Surface Layer:

The following radical polymerizable compound, solvent, and metal oxide fine particles were dispersed for 10 hours using a sand mill as a disperser under protection from light. The following photopolymerization initiator was added to the resulting dispersant, mixed, and stirred under protection from light until dissolved in the solution, to prepare a surface layer forming liquid [1].

Radical polymerizable compound: 100 parts by mass of trimethylolpropane trimethacrylate Solvent: 315 parts by mass of sec-butanol Solvent: 15 parts by mass of tetrahydrofuran Metal oxide fine particles: 150 parts by mass of tin oxide particles having a number average primary particle size of 20 nm and having the surface treated with the surface treatment agent ($CH_2{=}C(CH_3)COO(CH_2)_2Si(OCH_3)_3$)

Photopolymerization initiator: 12 parts by mass of "IRGACURE 819" (manufactured by BASF Japan)

Silane compound: 1 part by mass of triethylsilane

The surface layer forming liquid [1] was applied to the charge transport layer [1] using a circular slide hopper coater to form a coating film. The coating film was dried at room temperature for 20 minutes and then placed under nitrogen gas flow at a nitrogen flow rate of 13.5 L/min. A xenon lamp was used as a light source to irradiate the coating film with light (intensity: 4000 mW/cm$^2$, irradiation intensity of light for the coating film: 1800 mW/cm$^2$) having a wavelength of 365 nm at a lamp output of 4 kW for 18 seconds while the light source was kept 5 mm away from and the surface of the coating film, to form a surface layer [1] having a thickness of 3.5 urn, thereby producing an organic photoreceptor. This organic photoreceptor is defined as a photoreceptor [1].

Examples 2 to 8, Comparative Example 1

Photoreceptor Production Examples 2 to 9

Organic photoreceptors were produced in the same manner as in Photoreceptor Production Example 1 except that the type and the amount of the silane compound which was used in the step of forming the surface layer were changed as described in Table 1. These organic photoreceptors are defined as photoreceptors 2 to 9.

Comparative Example 2

Photoreceptor Production Example 10

An organic photoreceptor was produced in the same manner as in Photoreceptor Production Example 1 except that no triethylsilane was added. This organic photoreceptor is defined as a photoreceptor 10.

The photoreceptors 1 to 10 obtained above each were installed in a monochrome multifunction printer "BIZHUB PRESS 1250" (manufactured by Konica Minolta Holdings, Inc.) to carry out the following evaluations 1 to 3. The results are shown in Table 1.

Evaluation 1: Variation in Abrasion Loss of Thickness

The thickness of the protective layer was measured before and after durability printing test involving printing A4 images with a Bk coverage rate of 5.0% on 1,000,000 sheets of acid-free A4 paper under the conditions of a temperature of 30° C. and a humidity of 80% RH. The abrasion loss of the thickness was then calculated to evaluate variation in abrasion loss of the thickness.

For the thickness of the protective layer, the thickness of areas with a uniform thickness (except for thickness profile of areas with varying thickness at the front end area and the rear end area of coating) was measured at axial intervals of 5 mm and circumferential intervals of 120°. The average of the circumferential measured values was defined as the axial thickness profile of the protective layer. The difference between the maximum value and the minimum value of the axial thickness profile was defined as thickness variation. An eddy-current film thickness gauge "EDDY 560C" (manufactured by Helmut Fischer GmbH Co.) was used as a thickness measuring device.

In the present invention, the difference between the maximum value and the minimum value of the thickness profile of less than 0.60 μm is determined to be acceptable for practical use.

Evaluation 2: In-Plane Image Density Unevenness

After the durability printing test involving printing A4 images with a Bk coverage rate of 5.0% on 1,000,000 sheets of acid-free A4 paper under the conditions of a temperature of 30° C. and a humidity of 80% RH, a monochrome halftone image (average relative reflection density of 0.4 by a MACBETH densitometer) was then copied on the entire sheet of acid-free A3 paper under the conditions of a temperature of 10° C. and a humidity of 20% RH. In the A3 sheet (297 mm wide×420 mm long), total eight points were taken along the line 180 mm away from the short side at 33 mm intervals, and defined as a1, a2 . . . , and a8, respectively. Similarly, total eight points were taken along the line 195 mm away from the short side at 33 mm intervals, and defined as b1, b2 . . . , and b8, respectively. The reflection density of each point was measured with the MACBETH densitometer. The tolerance (difference between the maximum value and the minimum value) of the measured values at these 16 points was calculated and evaluated according to the following evaluation criteria. A smaller tolerance of the measured values indicates reduced in-plane image density unevenness.

In the present invention, the tolerance of less than 0.04 is determined to be acceptable for practical use.

Evaluation 3: Image Flowing

Just after the durability printing test involving printing A4 images with a Bk coverage rate of 5.0% on 1,000,000 sheets of acid-free A4 paper under the conditions of a temperature of 30° C. and a humidity of 80% RH, the main power of the image forming apparatus was turned off. At 12 hours after turning off the main power, the main power was turned on again and the image forming apparatus was ready for printing. Just after that, a halftone image (relative reflection density of 0.4 by a MACBETH densitometer) and a 6-dot lattice image were printed on the entire sheet of acid-free A3 paper. The conditions of the printed images were visually observed and evaluated according to the following evaluation criteria.

—Evaluation Criteria—

A: No image blurring was observed for both the halftone image and the lattice image (good)

B: A narrow band with decreased density was observed in the longitudinal direction of the photoreceptor only in the halftone image (acceptable for practical use).

C: The lattice image was lost by image blurring or the line width of the lattice image was tapered (unacceptable for practical use).

TABLE 1

| | | SILANE COMPOUND | | EVALUATION RESULTS | | |
|---|---|---|---|---|---|---|
| | PHOTORECEPTOR NO. | TYPE | ADDITION AMOUNT (PARTS BY MASS) | ABRASION LOSS OF THICKNESS (μm) | IN-PLANE IMAGE DENSITY UNEVENNESS | IMAGE FLOWING |
| EXAMPLE 1 | 1 | TRIETHYLSILANE | 1 | 0.30 | 0.009 | A |
| EXAMPLE 2 | 2 | TRIETHYLSILANE | 15 | 0.09 | 0.003 | A |
| EXAMPLE 3 | 3 | TRIETHYLSILANE | 30 | 0.23 | 0.008 | A |
| EXAMPLE 4 | 4 | TRIETHYLSILANE | 50 | 0.50 | 0.017 | A |
| EXAMPLE 5 | 5 | TRIPROPYLSILANE | 15 | 0.12 | 0.005 | A |
| EXAMPLE 6 | 6 | DIETHYLSILANE | 15 | 0.11 | 0.006 | A |
| EXAMPLE 7 | 7 | DIPROPYLSILANE | 15 | 0.10 | 0.006 | A |
| EXAMPLE 8 | 8 | METHYLPHENYLSILANE | 15 | 0.14 | 0.004 | A |
| COMPARATIVE EXAMPLE 1 | 9 | THIOL | 15 | 0.70 | 0.042 | B |
| COMPARATIVE EXAMPLE 2 | 10 | — | — | 1.50 | 0.060 | C |

The invention claimed is:

1. An organic photoreceptor comprising a conductive support, an organic photosensitive layer, and a surface layer made of a cured resin, which are stacked in this order wherein the surface layer is obtained by curing a composition containing a radical polymerizable compound for forming the cured resin, metal oxide fine particles having a surface treated with a silane coupling agent, and a silane compound represented by the following general formula (1), General Formula (1)

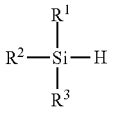

wherein $R^1$ to $R^3$ each independently represent a hydrogen atom, an alkyl group having 1 to 10 carbon atoms or an aryl group having 6 to 20 carbon atoms, and at least one of $R^1$ to $R^3$ represents an alkyl group having 1 to 10 carbon atoms or an aryl group having 6 to 20 carbon atoms.

2. The organic photoreceptor according to claim 1, wherein the silane compound is one selected from the group consisting of triethylsilane, tripropylsilane, diethylsilane, dipropylsilane, and methylphenylsilane.

3. The organic photoreceptor according to claim 1, wherein a content ratio of the silane compound is 1 to 30 parts by mass per 100 parts by mass of the radical polymerizable compound for forming the cured resin that constitutes the surface layer.

4. The organic photoreceptor according to claim 3, wherein the content ratio of the silane compound is 10 to 20 parts by mass per 100 parts by mass of the radical polymerizable compound for forming the cured resin that constitutes the surface layer.

5. The organic photoreceptor according to claim 1, wherein the metal oxide fine particles are made of tin oxide.

6. A production process of an organic photoreceptor, the organic photoreceptor including a conductive support, an organic photosensitive layer, and a surface layer made of a cured resin, which are stacked in this order, the process comprising:

applying a composition containing a radical polymerizable compound for forming the cured resin, metal oxide fine particles having a surface treated with a silane coupling agent, and a silane compound represented by the following general formula (1), to the organic photosensitive layer formed on the conductive support to form a coating film; and curing the coating film to form the surface layer, General Formula (1)

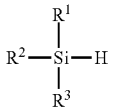

wherein $R^1$ to $R^3$ each independently represent a hydrogen atom, an alkyl group having 1 to 10 carbon atoms or an aryl group having 6 to 20 carbon atoms, and at least one of $R^1$ to $R^3$ represents an alkyl group having 1 to 10 carbon atoms or an aryl group having 6 to 20 carbon atoms.

* * * * *